US009482233B2

(12) United States Patent
Watson et al.

(10) Patent No.: US 9,482,233 B2
(45) Date of Patent: Nov. 1, 2016

(54) ELECTRIC SUBMERSIBLE PUMPING SENSOR DEVICE AND METHOD

(75) Inventors: Arthur I. Watson, Sugar Land, TX (US); John A. Booker, Missouri City, TX (US); Kenneth Armstrong, Danestone (GB); John David Rowatt, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 765 days.

(21) Appl. No.: 12/116,302

(22) Filed: May 7, 2008

(65) Prior Publication Data

US 2009/0277628 A1 Nov. 12, 2009

(51) Int. Cl.

| | |
|---|---|
| ***F04D 13/10*** | (2006.01) |
| ***E21B 47/01*** | (2012.01) |
| ***F04D 15/02*** | (2006.01) |
| *E21B 47/00* | (2012.01) |

(52) U.S. Cl.

CPC ..... *F04D 13/10* (2013.01); *E21B 47/01* (2013.01); *F04D 15/0209* (2013.01); *F04D 15/0218* (2013.01); *E21B 47/0007* (2013.01); *F04B 2207/02* (2013.01); *F04B 2207/03* (2013.01)

(58) Field of Classification Search

CPC ..... E21B 43/128; E21B 44/00; E21B 47/00; E21B 47/0007; E21B 47/01; E21B 47/06; F04D 13/10; F04D 15/0209; F04D 15/0218; F04B 2207/02; F04B 2207/03

USPC ..... 166/369, 250.01, 250.16, 105

See application file for complete search history.

(56) References Cited

U.S. PATENT DOCUMENTS

| | | | | |
|---|---|---|---|---|
| 4,583,923 | A * | 4/1986 | James | 417/414 |
| 4,603,735 | A * | 8/1986 | Black | 166/68 |
| 5,150,750 | A | 9/1992 | Lessi et al. | |
| 5,186,048 | A | 2/1993 | Foster et al. | |
| 5,213,159 | A * | 5/1993 | Schneider | 166/250.07 |
| 5,275,038 | A * | 1/1994 | Sizer et al. | 73/152.02 |
| 6,006,837 | A * | 12/1999 | Breit | 166/302 |
| 6,041,860 | A * | 3/2000 | Nazzal et al. | 166/250.01 |
| 6,263,730 | B1 * | 7/2001 | Grande et al. | 73/152.28 |
| 6,415,864 | B1 | 7/2002 | Ramakrishnan | |
| 6,595,295 | B1 * | 7/2003 | Berry et al. | 166/369 |
| 6,695,052 | B2 * | 2/2004 | Branstetter et al. | 166/250.15 |
| 7,114,557 | B2 | 10/2006 | Cudmore | |
| 7,258,164 | B2 | 8/2007 | Rezgui | |
| 7,445,042 | B2 | 11/2008 | Freer | |
| 7,448,447 | B2 | 11/2008 | Walford | |
| 7,481,270 | B2 | 1/2009 | Shepler | |
| 7,624,800 | B2 * | 12/2009 | Jamieson et al. | 166/250.01 |

(Continued)

FOREIGN PATENT DOCUMENTS

| | | |
|---|---|---|
| EP | 379813 | 8/1990 |
| GB | 2355033 | 4/2001 |

(Continued)

OTHER PUBLICATIONS

GCC/P/2009/13426, Examination Report dated Feb. 22, 2016, 7 pgs.

*Primary Examiner* — Elizabeth Gitlin

(74) *Attorney, Agent, or Firm* — Michael Stonebrook

(57) ABSTRACT

An electric submersible pump device has a pump and a motor. The motor can be adjacent to the pump. A support member supports the sensor and has a length so that the sensor is located a first distance downhole from a downhole distal end of the motor.

12 Claims, 3 Drawing Sheets

(56) References Cited

U.S. PATENT DOCUMENTS

| | | | | |
|---|---|---|---|---|
| 7,640,979 | B2 * | 1/2010 | Watson et al. | 166/254.2 |
| 8,087,461 | B2 * | 1/2012 | Fitzgerald | 166/254.2 |
| 2004/0154390 | A1 * | 8/2004 | Baustad | 73/152.55 |
| 2005/0109515 | A1 * | 5/2005 | Watson et al. | 166/369 |
| 2006/0162934 | A1 | 7/2006 | Shepler | |
| 2006/0266064 | A1 | 11/2006 | Rowatt | |
| 2006/0266526 | A1 | 11/2006 | Ocalan | |
| 2007/0017672 | A1 | 1/2007 | Kayadarma | |
| 2007/0107907 | A1 | 5/2007 | Smedstad | |
| 2007/0114040 | A1 | 5/2007 | Jamieson | |
| 2007/0144746 | A1 | 6/2007 | Jonas | |
| 2007/0199696 | A1 | 8/2007 | Walford | |
| 2007/0227727 | A1 | 10/2007 | Patel | |
| 2007/0235185 | A1 | 10/2007 | Patel | |
| 2007/0252717 | A1 | 11/2007 | Fielder | |
| 2007/0289779 | A1 | 12/2007 | Howard | |
| 2007/0295504 | A1 | 12/2007 | Patel | |
| 2008/0041576 | A1 | 2/2008 | Patel | |
| 2008/0236821 | A1 | 10/2008 | Fielder | |
| 2008/0272932 | A1 | 11/2008 | Booker | |
| 2009/0032264 | A1 | 2/2009 | Shepler | |
| 2009/0066535 | A1 | 3/2009 | Patel | |

FOREIGN PATENT DOCUMENTS

| | | |
|---|---|---|
| GB | 2369631 | 6/2002 |
| GB | 2408758 | 6/2005 |
| GB | 2419924 | 5/2006 |
| GB | 2432175 | 5/2007 |
| GB | 2432378 | 5/2007 |
| GB | 2448017 | 10/2008 |
| GB | 2450517 | 12/2008 |
| WO | 9012196 | 10/1990 |
| WO | 2001027432 | 4/2001 |
| WO | 2001027432 | 10/2001 |
| WO | 2003106932 | 12/2003 |
| WO | 2004038950 | 5/2004 |
| WO | 2005085590 | 9/2005 |
| WO | 2007003445 | 1/2007 |
| WO | 2007083192 A1 | 7/2007 |
| WO | 2007107815 | 9/2007 |
| WO | 2008060769 | 5/2008 |

* cited by examiner

ELECTRIC SUBMERSIBLE PUMPING SENSOR DEVICE AND METHOD

TECHNICAL FIELD

The present application generally relates to an electric submersible pump device configured for sensing parameters a distance downhole from the electric submersible pump, and associated methods.

BACKGROUND

Fluids are located underground. The fluids can include hydrocarbons (oil) and water, for example. Extraction of at least the oil for consumption is desirable. A hole is drilled into the ground to extract the fluids. The hole is called a wellbore and is oftentimes cased with a metal tubular structure referred to as a casing. A number of other features such as cementing between the casing and the wellbore can be added. The wellbore can be essentially vertical, and can even be drilled in various directions, e.g. upward or horizontal.

Once the wellbore is cased, the casing is perforated. Perforating involves creating holes in the casing thereby connecting the wellbore outside of the casing to the inside of the casing. Perforating involves lowering a perforating gun into the casing. The perforating gun has charges that detonate and propel matter thought the casing thereby creating the holes in the casing and the surrounding formation and helping formation fluids flow from the formation and wellbore into the casing.

Sometimes the formation has enough pressure to drive well fluids uphole to surface. However, that situation is not always present and cannot be relied upon. Artificial lift devices are therefore needed to drive downhole well fluids uphole, e.g., to surface. The artificial lift devices are placed downhole inside the casing. Obtaining information relating to the operation of the artificial lift devices can be beneficial. One way of obtaining that information is with downhole sensors.

The present application describes a downhole electric submersible pump (ESP) with a sensor for sensing downhole parameters below the ESP and associated methods.

SUMMARY

According to an embodiment, an electric submersible pump device, comprising: a pump; a motor, the motor being adjacent to the pump and having motor windings extending a first distance along the motor; a support member, the support member supporting the sensor and having a length so that the sensor is located the first distance downhole from the downhole distal end of the motor windings; the sensor device comprising at least one selected from the following: a temperature sensor, a flow-meter, a vibration sensor or a pressure sensor.

DETAILED DESCRIPTION

In the following description, numerous details are set forth to provide an understanding of the present invention.

However, it will be understood by those skilled in the art that the present invention may be practiced without many of these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Artificial lift devices are used to drive downhole fluids uphole. One such device is called an electric submersible pump (ESP). An ESP typically includes a pump, e.g., a centrifugal pump, which is mechanically connected to a motor. The motor drives the pump and is electrically powered. The motor is located downhole from the pump so that well fluids pass over the motor thereby helping keep the motor cool. The power is delivered from surface via an electrical wire. In addition to electric power, communication signals can be transmitted along the electric wire in certain situations. Also, an additional communication medium can be used. There are numerous ESP designs available commercially from Schlumberger. Specific designs of such are therefore not described in this application.

An ESP can be located above a perforated area of a casing. The pump can be positioned a certain distance uphole from the perforations. That is, the location where the well fluids flow into the casing can be below the ESP.

A sensor can be incorporated with an ESP to measure certain wellbore parameters. Some of those parameters are pressure, temperature, vibration, flow rate, density, fluid/gas mixture, voltage leak, etc. Those parameters can be measured in almost any location, e.g., at the level of the pump or motor, in the pump or motor, outside the pump or motor, in the casing, outside the casing, etc. However in the context of the present application, measuring at least one or some of those parameters within the casing and below the ESP at or near the perforations, e.g., the sandface, is particularly desirable.

Accordingly, the present application describes a sensor device that is a distance downhole from an ESP, e.g., a motor of the ESP and specifically a lower distal end of the windings in the motor, thereby locating the sensor device proximate to perforations.

Figure 1:
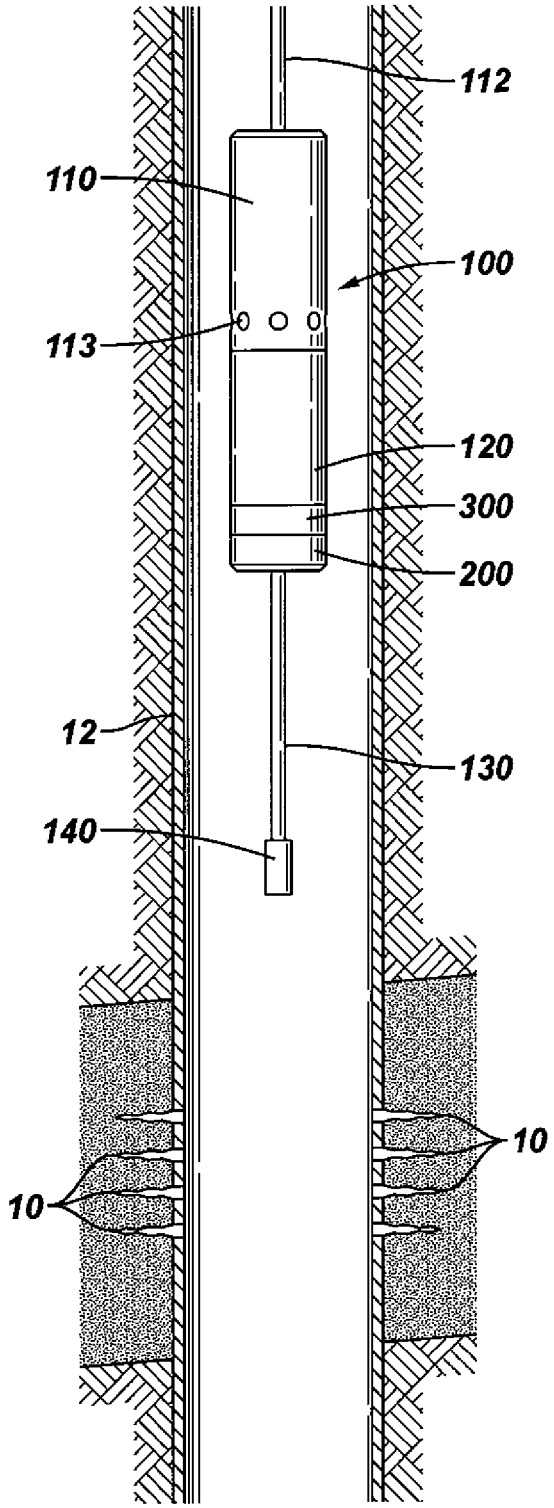
FIG. 1 shows an embodiment.

FIG. 1 shows an ESP 100 including a pump 110 and a motor 120. As noted above, the motor 120 has windings therein (not shown) that extend for a distance within the motor 120. A sensor 140 is located downhole from a downhole distal end of the windings. The motor 120 is mechanically connected with the pump 110 so that the motor 120 drives the pump 110. The motor 120 can be located downhole from the pump 110 to help cool the motor 120. The ESP 100 is connected to suspension member 112. The suspension member 112 can be any device used to suspend an ESP downhole such as coiled tubing or wireline. The pump 110 can be a centrifugal style pump having intake openings 113 for entrance of well fluids and an outlet (not shown) for expulsion of well fluids. The ESP outlet can be connected to production tubing that extends uphole. The production tubing can be coiled tubing or jointed tubing, or in the alternative the well fluids can be driven up though the casing 12. Often, packers are used in conjunction with driving well fluids up the casing or production tubing. A gauge 300 can connect to the motor 120. A support device 130 can be connected between a downhole end of the motor 120 or the gauge 300 and the sensor 140. An adapter 200 can be connected between the support device 130 and the motor 120, or between the support device 130 and the gauge 300. The ESP 100 can be configured without the gauge 300 and/or the adapter 200. The sensor 140 is preferably a SAPPHIRE™ Sensor, which is available commercially from Schlumberger. However, many sensors are suitable and can be implemented while not deviating from the application.

Figure 2:
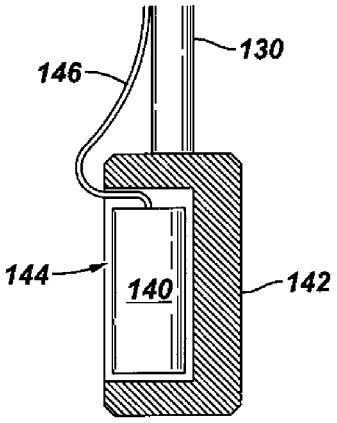
FIG. 2 shows an embodiment of certain features.
Figure 3:
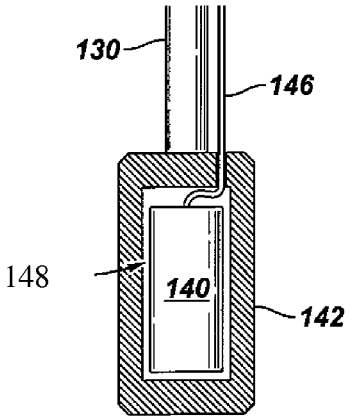
FIG. 3 shows an embodiment of certain features.

As shown in FIGS. 2 and 3, a sensor case 142 can be located at an end of the support device 130. That sensor case 142 can be configured to provide support and/or protection for the sensor 140. The sensor case 142 can have an open side defining a recess 144 adapted so that the sensor 140 fits therein. That configuration is shown in FIG. 2. Normally the internal recess 144 side will face outward in a radial direction to the side. In another configuration, the sensor case 142 can also have an inner cavity 148 adapted to contain the sensor 140. The inner cavity 148 can be substantially surrounded by the sensor case 142, for example, 360 degrees around in a radial direction. That configuration is shown in FIG. 3. There can be openings in the sensor case 142 so that while the sensor 140 is in the inner cavity 148 electrical wire 146 can be connected between the sensor 140 and the outside of the sensor case 142. The sensor case 142 can be configured so that the electrical wire 146 extends upward and into the support device 130, e.g., when the support device 130 is a tube, or so that the electric wire 146 extends adjacent to the support device 130.

Figure 4A:
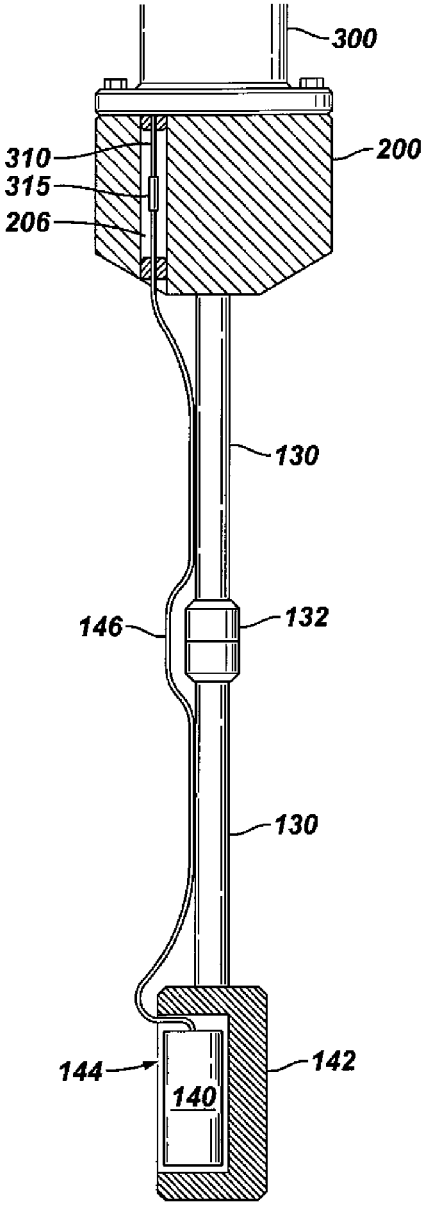
FIGS. 4*a* and 4*b* show other embodiments of certain features.
Figure 4B:
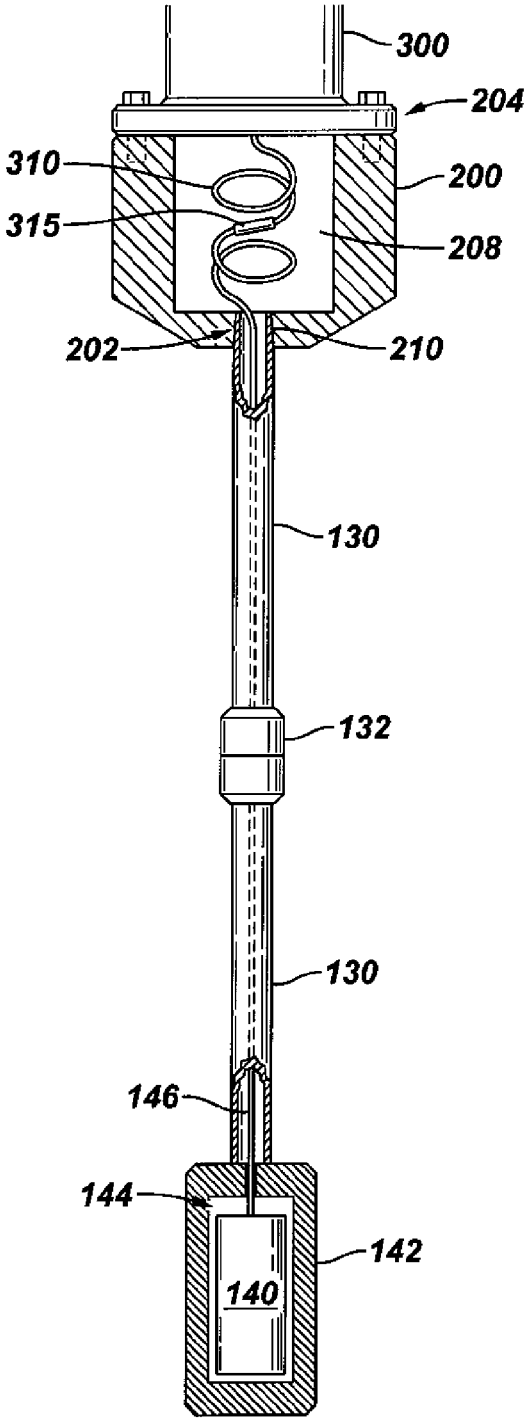

The adapter 200 is designed to connect the support device 130 and the motor 120. FIGS. 4*a* and 4*b* show an embodiment including an adaptor 200. The adapter 200 has a threaded portion 202, preferably female, which is designed to connect with the support device 130. For example, the support device 130 can be jointed tubing and can screw into the threaded portion 202 of the adapter 200. The jointed tubing can be connected by connectors 132. The connectors 132 can preferably be threaded, clamp or flange connectors. The adapter has a connection portion 204 that is adapted to be connected with the motor 120 or the gauge 300. The connection portion 204 is preferably a flange connection that is bolted to the motor 120, but could also be a threaded connection, or clamped connection.

As noted above, the sensor 140 can be connected electrically with the gauge 300. An electrical connection 315 is preferably established during deployment by connecting wire 146 with wire 310. The adapter 200 can be configured to facilitate that connection 315. For example, according to FIG. 4*a*, the adapter can have a channel 206 extending through the adapter 200 through which a wire 146 connecting with the sensor 140 can connect with a wire 310 connecting with the gage 300. One of the wires can be connected with a telescoping wire head (not shown) to facilitate the connection 315. As shown in FIG. 4*b*, the adapter 200 could have an open volume 208 therein. For deployment, a wire 146 from the sensor 140 can extend through an opening in the adapter 210 and into the volume 208. The adapter 200 can be screwed onto the support member 130. A wire 310 can extend from the gage 300 and be long enough so that the gage 300 can be a distance from the adapter 200 while allowing the wire 146 from the adapter 200 to be connected with the wire 310 from the gage 300. Before the motor 120 and gage 300 are lowered onto the adapter 200, the wires are connected to one another electrically and are placed into the volume 208. The motor 120 and gauge 300 are then lowered into position adjacent to the adapter 200 and bolted together, while maintaining the wires in the volume 208. In connection with those deployments mentioned, the wire 146 from the sensor 140 can be located within the support device 130 or outside the support device 130. Preferably, the support device 130 is located downhole below a wellhead (not shown), then the adapter 200 is crewed to the support device 130, and then the motor 120 is lowered and bolted to the adapter 200. Of course, the connection of the support device 130 to the adapter 200 could be made while both the adapter 200 and the support device 130 are at surface.

The support device 130 can have a number of configurations, e.g., a hollow tubular shape, a u-shape, an I-shape, and/or of multiple strands. Normally the support device 130 is constructed from metal, but many other suitable materials are or will be available such as ceramics, polymers, and composites. The support device 130 can have a longitudinal length that is at least as great as the longitudinal length of the motor 120 or the pump 110, or the motor 120 and pump 110 together. The support device 130 can be multiple pieces that are connected by the connector 132. The connector 132 can be a threaded, a clamped, or a flanged connection. Alternatively, the support device may be of one piece, deployed form a spool.

There are numerous ways to deploy the sensor 140 according to the present application. For example, the ESP 100 can be downhole while the sensor 140 is connected electrically in the sensor casing 142. The sensor 140 can be located in the sensor casing before being electrically connected and before the ESP 100 is lowered downhole, after which the sensor 140 can be connect electrically. Another option is to locate the ESP 100 and sensor casing downhole without the sensor 140, and to then feed the sensor 140 downhole and into the sensor casing 142. It should be appreciated that a sensor casing 142 is not necessarily required according to the application, and these operations can be done with a device that does not include a sensor casing 142.

The sensor 140 can be connected to an electrical wire that connects with the motor 120, e.g., the electrical wire of the motor 120. Alternatively, the electrical wire 146 connecting with the sensor 140 could extend farther uphole than the ESP 100. The sensor 130 could also connect with a fiber-optic wire, or a combination of fiber-optic wire and electric wire.

The sensor 140 can be located at least 30, 60, or 100 meters below the bottom of the motor 120. The sensor 140 could also be a distance below the bottom of the motor 120 equal to at least the distance the motor windings extend along the motor 120 from top to bottom.

Figure 5:
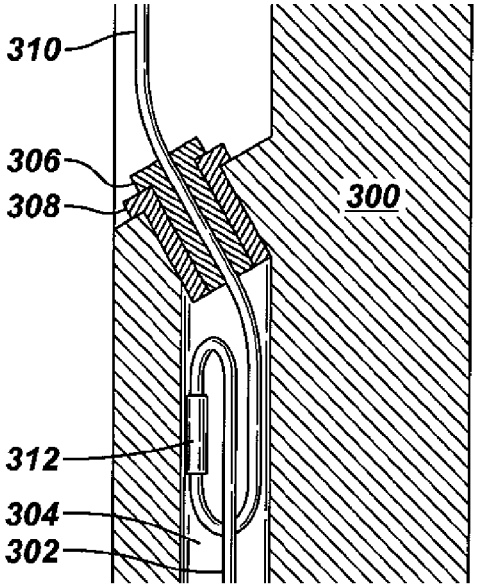
FIG. 5 shows an embodiment of certain features.

FIG. 5 shows a section view of an upper portion of the gauge 300. The gauge 300 has a wire 302 extending uphole from a volume 304 within the gauge. The wire 302 can be connected with another wire 310, and the connection 312 can be positioned within the volume 304. A plug 306 connects with the uphole wire 310. A plug sleeve 308 is in threaded connection within an opening of the volume 304 within the gauge 300. When connecting the wire 302 extending from the gauge 300, the wire 302 extends outside the volume 304 through the opening and the plug sleeve 308. The wire 302 is then connected with the uphole wire 310 that extends though the plug 306. The plug 306 is then threaded into place within the plug sleeve 308, thereby placing the connection within in the volume 304. Alternatively, both plug 306 and plug sleeve 308 may be attached to wire 310 and apart from gauge 300 while connecting wires 310 and 302. Afterwards, plug 306 and plug sleeve 308 can be threaded into volume 304.

The embodiments referred to above are meant to illustrate a number of embodiments including a number of features included in the inventive idea. The embodiments are in no way meant to limit the scope of the claims herein.

The invention claimed is:

1. An electric submersible pump device, comprising:

a pump;

an electric motor mechanically connected below the pump;

an electric submersible pump gauge connected below the electric motor, the electric submersible pump gauge comprising a plug sleeve assembly disposed within an opening in an exterior wall of the electric submersible pump gauge, the plug sleeve assembly comprising a plug sleeve and a plug, the plug disposed about an uphole wire such that a portion of the uphole wire is inside of the electric submersible pump gauge;

a support member connected below the electric submersible pump gauge and secured to the electric submersible pump gauge via an adapter;

a sensor case connected to the support member; and a sensor disposed within a recess on a lateral surface of the sensor case, the sensor comprising at least one selected from a group consisting of: a temperature sensor, a flow-meter, a vibration sensor and a pressure sensor, wherein the sensor is disposed at a distance from the electric motor that is greater than a longitudinal length of the motor, the sensor being in electric communication with the electric submersible pump gauge via a second wire routed along the support member, through the adapter, and into the electric submersible pump gauge wherein the second wire is in electrical communication with the uphole wire.

2. The electric submersible pump device of claim 1, wherein the support member is a hollow tubular member.

3. The electric submersible pump device of claim 1, wherein the support member is jointed tubing.

4. The electric submersible pump device of claim 1, comprising an adapter, the adapter having a threaded connector portion adapted to attach to the support member, and a connector portion adapted to bolt to a part.

5. The electric submersible pump device of claim 1, wherein the gauge is electrically connected to the motor and has an electrical conduit for connecting to an electrical conduit connected with the sensor; wherein the electrical conduit connected with the sensor is a wire.

6. The electric submersible pump device of claim 5, wherein a connector portion of an adapter is adapted to bolt to the gauge, wherein the electrical conduit of the gauge can be connected to the electrical conduit from the sensor while the adapter is bolted to the gauge.

7. The electric submersible pump device of claim 1, wherein the support member has a longitudinal length which positions the sensor at least 30 meters from a bottom of the electric motor.

8. The electric submersible pump device of claim 1, wherein the support member is a separate removable part.

9. The electric submersible pump device of claim 1, wherein the support member is selected from a group consisting of: coiled tubing and cable.

10. An electric submersible pump device, comprising:

a pump;

an electric motor mechanically connected to the pump;

an electric submersible pump gauge connected below the electric motor, the electric submersible pump gauge comprising a plug sleeve assembly disposed within an opening in an exterior wall of the electric submersible pump gauge, the plug sleeve assembly comprising a plug sleeve and a plug, the plug disposed about an uphole wire such that a portion of the uphole wire is inside of the electric submersible pump;

a support member connected to an adapter located below the electric submersible pump gauge;

a sensor case connected to the support member, the sensor case having an inner cavity;

a sensor disposed within the inner cavity of the sensor case; and a second wire coupling the sensor with the electric submersible pump gauge, the second wire being joined by a connection located in proximity to the adapter between the support member and the gauge to facilitate communicative coupling of the sensor with the gauge and wherein the second wire is in electrical communication with the uphole wire.

11. The electric submersible pump device of claim 10 wherein the electric motor comprises a longitudinal length and wherein the support member comprises a longitudinal length equal to or greater than the longitudinal length of the electric motor.

12. The electric submersible pump device of claim 10 wherein the support member comprises a longitudinal length that positions the sensor at least 30 meters from a bottom of the electric motor.

* * * * *